US008800885B2

(12) United States Patent
Mediavilla

(10) Patent No.: US 8,800,885 B2
(45) Date of Patent: Aug. 12, 2014

(54) RAILWAY CLIP INSULATOR WITH TWO STABLE POSITIONS FOR STANDBY, PARKED OR PRELOADED POSITION AND INSTALLED, LOADED OR FINAL POSITION

(75) Inventor: Jose Ricardo Mediavilla, Kansas City, MO (US)

(73) Assignee: Amsted Rail Company, Inc.

( * ) Notice: Subject to any disclaimer, the term of this patent is extended or adjusted under 35 U.S.C. 154(b) by 282 days.

(21) Appl. No.: 13/146,331

(22) PCT Filed: Feb. 3, 2010

(86) PCT No.: PCT/IB2010/000311

§ 371 (c)(1),
(2), (4) Date: Sep. 30, 2011

(87) PCT Pub. No.: WO2010/089668

PCT Pub. Date: Aug. 12, 2010

(65) Prior Publication Data

US 2012/0031992 A1 Feb. 9, 2012

(30) Foreign Application Priority Data

Feb. 4, 2009 (AU) ..... 2009900388

(51) Int. Cl.
*E01B 9/48* (2006.01)

(52) U.S. Cl.
USPC ..... 238/351

(58) Field of Classification Search
USPC ..... 238/351–354
See application file for complete search history.

(56) References Cited

U.S. PATENT DOCUMENTS

| | | | | |
|---|---|---|---|---|
| 5,110,046 | A * | 5/1992 | Young | 238/283 |
| 5,520,330 | A * | 5/1996 | Brown et al. | 238/351 |
| 5,551,633 | A * | 9/1996 | Kish et al. | 238/283 |
| 6,367,704 | B1 * | 4/2002 | Mediavilla | 238/310 |
| 6,604,690 | B2 * | 8/2003 | Young | 238/270 |
| 2007/0138311 | A1 | 6/2007 | Young | |
| 2008/0203181 | A1 * | 8/2008 | Young et al. | 238/351 |

FOREIGN PATENT DOCUMENTS

| | | | |
|---|---|---|---|
| DE | 4116306 | A1 | 11/1992 |
| DE | 202007018500 | | 8/2008 |
| FR | 2656882 | A1 | 7/1991 |
| WO | WO-2006032072 | A1 | 3/2006 |

* cited by examiner

*Primary Examiner* — Zachary Kuhfuss
(74) *Attorney, Agent, or Firm* — The Belles Group, P.C.

(57) ABSTRACT

A rail seat includes a concrete rail tie; a pair of rail clip support shoulders cast in place in said rail tie each said shoulder having a rail face between its external sides; a pair of shoulder insulators each shaped to lie against the rail face of the rail shoulder; a pair of rail clips each having a base section adapted to seat within the rail clip support shoulder and a toe section adapted to seat on the rail base. The clip and toe insulator assembly is loaded on the shoulder in a vertical direction so that parts of the toe insulator seat within pockets in the shoulder that enable the clip and insulator assembly to move laterally towards the rail but not away from it and the clip base is aligned with the shoulder slot ready to enter it when the clip is moved laterally to the parked position which applies a small downward force to the clip toes and at this stage lie outside the limits of the rail base and finally the clip can be moved laterally into the installed position where the toe insulators sit on top of the rail base and securely hold it down.

2 Claims, 5 Drawing Sheets

RAILWAY CLIP INSULATOR WITH TWO STABLE POSITIONS FOR STANDBY, PARKED OR PRELOADED POSITION AND INSTALLED, LOADED OR FINAL POSITION

CROSS REFERENCE TO RELATED APPLICATIONS

This application is a National Phase filing under 35 U.S.C. §371 of PCT/IB2010/000311 filed on Feb. 3, 2010; and this application claims priority to Application No. 2009900388 filed in Australia on Feb. 4, 2009 under 35 U.S.C. §119; the entire contents of all are hereby incorporated by reference.

TECHNICAL FIELD

This invention relates to a rail fastening assembly of the type where a rail is clamped to a rail seat by elastic rail fasteners held in shoulders fastened to the tie and insulators isolate the rail fastener and support shoulders from the rail. The present invention addresses problems associated with the insulators.

BACKGROUND

Concrete ties have been in use in some parts of the world for a long time but it is only since 1985 that they have been able to provide cost benefits for use in North America relative to wooden ties.

One advantage of concrete ties is that the rail seats can be pre assembled with only a few components to be added on site when the rail is placed in position. The difficulty with this is that the pre assembled components can become dislodged during transport and some components still have to be positioned on the rail. The rail seats usually comprise a rail pad that is positioned below the rail, an abrasion resistant plate below the pad, rail clip support shoulders on the field and gauge sides of the rail, an elastic rail clip that seats in the support shoulder and bears down on the rail base and an insulator that lies between the rail and the rail clip and the support shoulder. The support shoulders are precast in the rail tie and the rail pad is fitted between each pair. Because the rail clips and insulators contact the rail when fastened they cannot be placed in position until the rail has been placed in position on the rail seat. Rail seat assemblies of this type have been generally described in U.S. Pat. Nos. 5,110,046, 5,551,633 and 6,604,690. The rail clips in these assemblies are either installed or loose and therefore have to be assembled on site.

When new insulated railway track is being laid the ties are positioned first. Usually the rail pads are captive on the ties and sometimes the clips are also captive in the shoulders. Next the rail is threaded into the rail seats and the rail is centered in each seat and the insulators placed between the rail base edges and the shoulders. Finally the clips are pushed into the installed position.

U.S. Pat. No. 6,367,704 proposed using a modified support shoulder so that the clip could be partially installed for transport purposes where it was retained on the shoulder and then able to be fully installed when the rail was placed in position. In this arrangement the insulators still needed to be placed in position manually before the clip could be fully installed.

However it is difficult to position the rail exactly central in the rail seat so that the insulators can be fitted between the shoulders and the rail. This operation takes considerable manpower and time. In addition starting the clips by hand in readiness for the clip fitting machine also consumes time.

U.S. Pat. No. 5,520,330 discloses a bent rod rail clip with a two part insulator that enables the rail seat to be pre-assembled at the tie plant.

U.S. patent application No. 2008/0203181 discloses a system which divides the insulator into two parts. The first part is the shoulder insulator which separates the rail base edge from the shoulder and the second part is the clip toe insulator which is made captive on the clip toe. The clip and toe assembly is then made so it can be parked on the shoulder and also holds the shoulder insulators in place. The pad is also made captive in the rail seat.

With this arrangement all the rail fastening components can be assembled in the parked position at the tie plant and when the tie is delivered to the track the rail can be threaded into the rail seat and a machine used to install the clips thereby saving a lot of time previously used centering the rail and fitting the insulators and starting the clips.

However for this to be satisfactory the parked fastening system must be capable of guiding the rail into the rail seat if the rail is not presented exactly centrally which occurs very frequently.

The rail is stiff and heavy and capable of imparting a severe blow to the parked fastening system which can result in broken insulators. The blow from the rail is usually in a vertical or horizontal direction so with laterally applied clips it tends to knock them backwards out of the parked position or worse still breaks the insulator. This then takes considerable time to reposition the clips and replace the broken parts. When this occurs the replacement of insulators and clips can be time consuming and inefficient It is an object of this invention to provide an insulator combination that is less liable to damage during assembly.

SUMMARY OF THE INVENTION

To this end the present invention provides a railroad tie and rail seat assembly for supporting a rail which includes a. a rail tie
b. a pair of rail clip support shoulders attached to the said rail tie and each said shoulder having a rail base abutment face and on the opposite side there is a slot which extends towards the rail and is capable of accepting a clip base when applied laterally towards the rail
c. a pair of shoulder insulators each shaped to lie between the rail base edge and the rail abutment face of the shoulders
d. a pair of rail clips each having a base section adapted to slide into the rail clip support shoulder slot and the toe section adapted to seat on the rail base, the toe section comprising a pair of bifurcated arms extending from the said base section and being bent into a curve so that the toes lie adjacent but beyond the clip base
e. a pair of toe insulators each captive on the rail clip toes to electrically insulate the clip from the rail base
f. the clip and toe insulator assembly is loaded on the rail clip support shoulder in a vertical direction so that parts of the toe insulator seat within pockets in the rail clip support shoulder that enable the clip and toe insulator assembly to move laterally towards the rail but not away from it
g. in the loaded position the clip base is aligned with the shoulder slot and enters it when the clip is moved laterally to the parked position in which the clip and toe insulator lie outside the limits of the rail base
h. In the installed position the toe insulators sit on top of the rail base and securely hold it down.

This invention overcomes the difficulty with the prior art arrangement by loading the insulator vertically onto the shoulder so that the ends of the insulator sit in pockets in the shoulder which allow the insulator to move forward towards the rail but not backwards. The toe insulator can then be made of robust construction so that it can guide the rail into the seat. Any large laterally outward force can then be transmitted through the insulator directly to the shoulder without knocking the clip off the shoulder.

The clip and toe insulator are delivered to the tie plant as a complete assembly and loaded vertically onto the shoulder at the tie plant. In this loaded position the base of the clip is aligned with the shoulder slot in readiness for the clip to be moved laterally towards the rail seat centre into the parked position where it is held by a pawl in the shoulder insulator engaging in a slot in the toe insulator. The rail seat is now ready to receive the rail when it reaches the track.

If the rail imparts a heavy lateral blow to the toe insulator during rail threading the clip and toe insulator assembly may be knocked out of the parked position into the loaded position where the insulator is then supported by the shoulder and cannot move any further. The rail will still be guided into the rail seat and the clip machine can still put the clip on. The only disadvantage of the clip and toe assembly being in the loaded position is that post insulator and pad are not being held down by the clip and toe insulator but this does not matter since at this point in the process the rail is now holding the pad down.

In a preferred embodiment the toe insulator includes wing extensions that abut portions of the support shoulder to prevent movement of the insulator in a direction away from the rail. To insert the clip and toe insulator in place they are dropped vertically into position rather than laterally. To complete the installation when the rail is in place the clip is pushed onto the rail base in the usual way. To secure the toe insulator in the two stable positions the bottom surface of the toe insulator preferably includes two ratchet like protrusions that interact with a complementary protrusion on the top surface of the shoulder insulator.

DETAILED DESCRIPTION OF THE INVENTION

A preferred embodiment of the invention will now be described with reference to the drawings in which FIG. 1 is a side view of a rail seat illustrating one embodiment of this invention with the left hand clip fully installed and the right hand clip in the loaded position;

Figure 1:
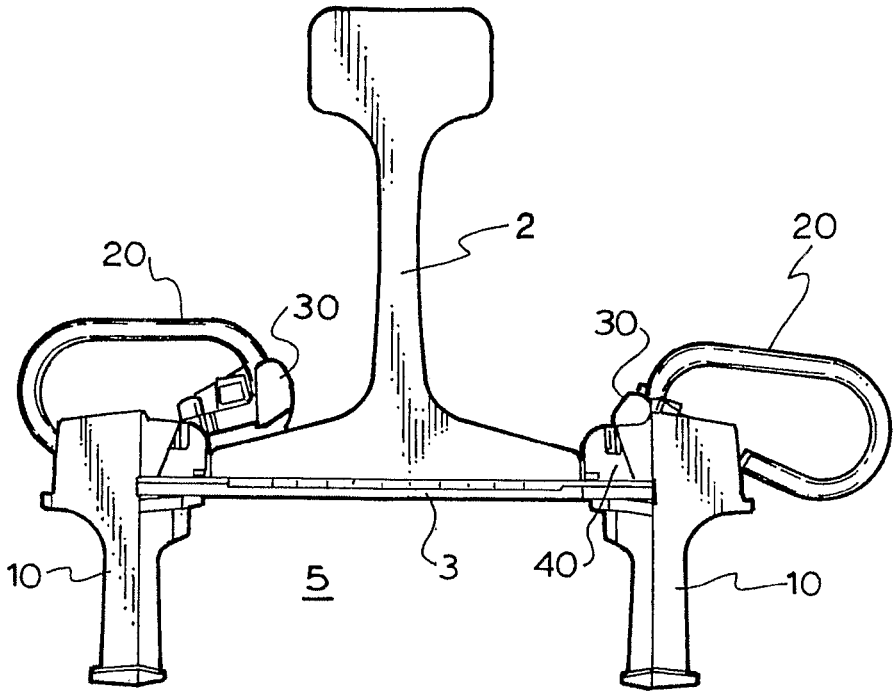
Figure 2:
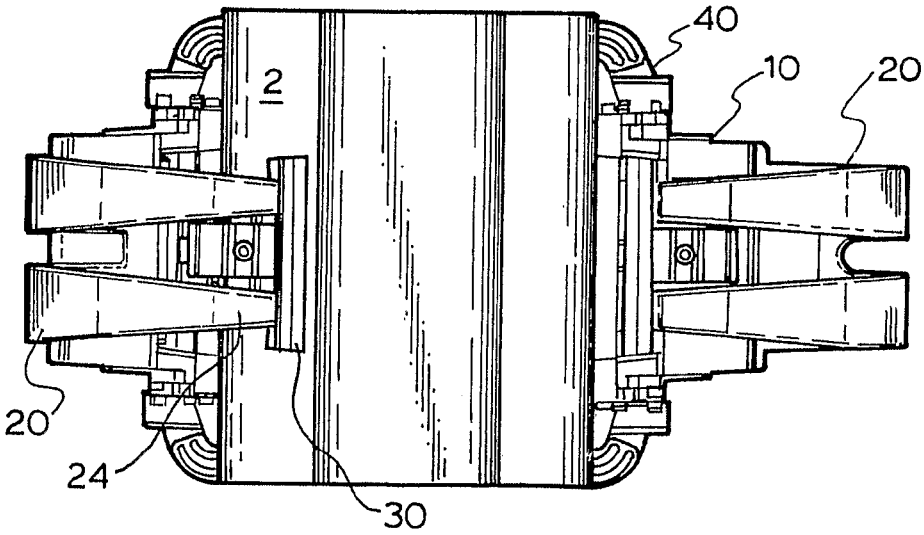
FIG. 2 is a plan view of the embodiment of FIG. 1.

The rail seat comprises a concrete rail tie 5 into which has been cast the rail clip support shoulders 10. Between the two shoulders 10 are positioned a rail pad 3. The rail 2 seats on the rail pad 3. This rail pad may incorporate a recess at its edge adjacent the shoulder 10 to accommodate a combined shoulder 10 and shoulder insulator 40.

The base 22 of rail clip 20 is securely held within the shoulder 10 and the toe section 24 seats within the toe insulator 30 that lies on the rail base 2. The shoulder insulator 40 is attached to shoulder 10 and lies between the rail base 2 and the shoulder 10 and extends down to the rail pad 3.

The rail clip 20 is made from a flat metal stamping bent into its final 3 dimensional state. Rail clips of this kind are known from U.S. Pat. No. 6,367,704. The rail clip consists of a base web 22 which bifurcates into arms 23 that end in the toe portions 24. The ends 25 of the toe portion 24 are shaped to enable the clip 20 to be held in a partially applied position in the shoulder 10. The rail clip 20 and shoulder 10 are designed so that the clip has three stable positions in the shoulder namely a loaded position, a parked position where a rail can be plated in position on the rail seat and a fully loaded or installed position in which the toe 24 of the rail clip is over the rail base 2.

Figure 3:
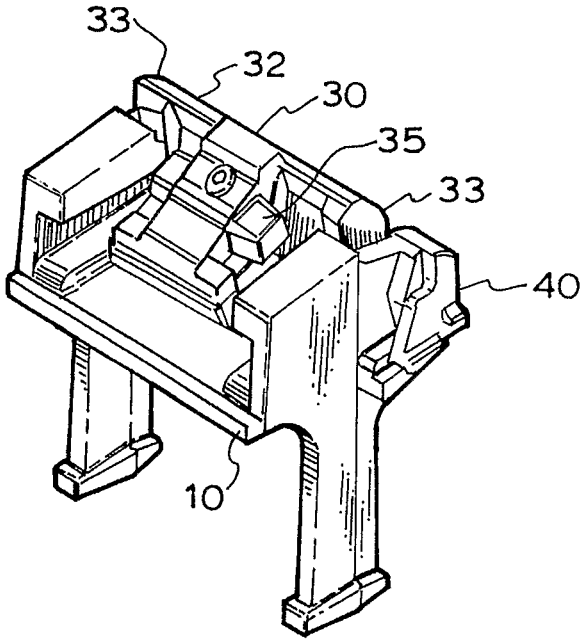
FIG. 3 is a rear perspective view of the shoulder, the shoulder insulator and the toe insulator without a rail clip in the loaded position.
Figure 4:
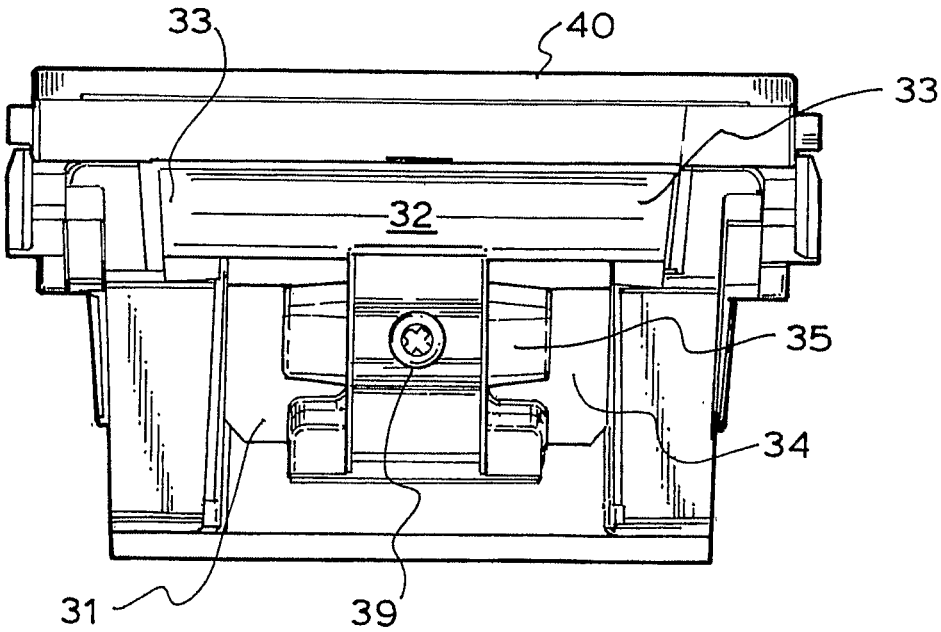
FIG. 4 is a plan view of FIG. 3.
Figure 5:
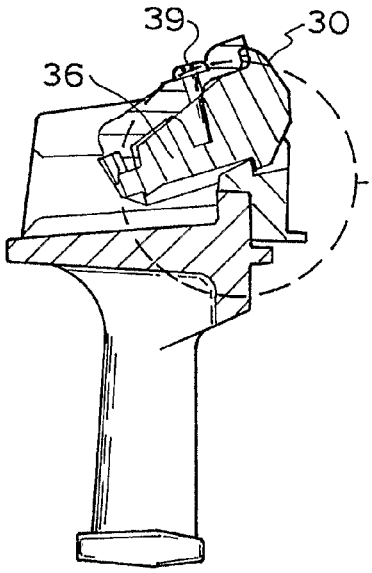
FIG. 5 is a sectional view showing the toe insulator in the parked position.
Figure 14:
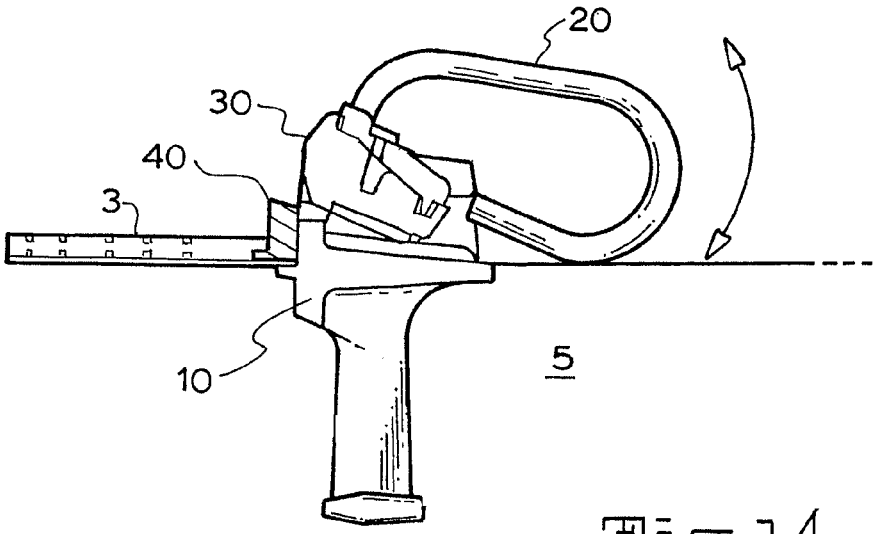
FIG. 14 shows a section view of the clip and toe insulator vertically dropped into position.
Figure 15:
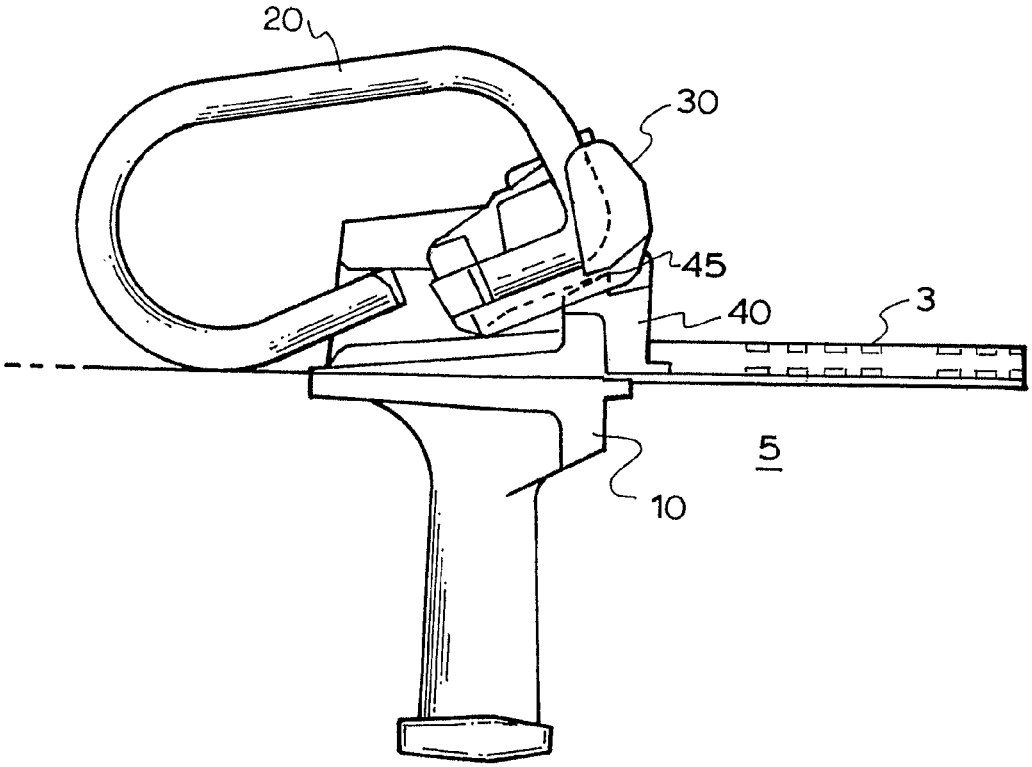
FIG. 15 is a section view of the park position.

The toe insulator 30 of this invention is a modified version of the toe insulator disclosed in U.S. patent application No. 2008/0203181. The toe insulator 30 consists Of a base portion 31 a front wall 32 toe compartments 34 and clip retainer bars 35 that attach the toe insulator 30 to the toes 24 of the clip 20. In this invention the front wall 32 is extended by wings 33 which are designed to fit into recesses 15 between the shoulder slot roof 14 and the front wall or rail face 12 of shoulder 10. This can be seen in FIGS. 3 and 4. When the clip and toe insulator are in the loaded position the portion 12 of the shoulder 10 prevents the toe insulator 30 from moving away from the rail. Thus the toe insulator and clip cannot be displaced beyond this point, when the rail is being installed by threading through the rail seats. In U.S. patent application No. 2008/0203181 the clip 20 and toe insulator 30 combination were loaded laterally through the rear entry of the shoulder 10. In the present invention the combined clip and toe insulator are vertically dropped into position from above as shown in FIG. 14 and the pushed into the parked position as shown in FIG. 15. This arrangement contrasts with other prior art fastening assemblies where the clip and toe insulator are applied laterally but the toe insulator must pass through a gate which then makes it very difficult to provide a heavy duty stop to prevent backward movement from the parked position.

Another advantage of this invention is that the toe insulator 30 is made up of two parts which are screwed together by screw 39 to become captive on the clip. In the unlikely event of the insulator being broken during installation it is possible for the track men to replace the insulator on the spot. Some other prior art toe insulators are very difficult to replace in track.

Figure 6:
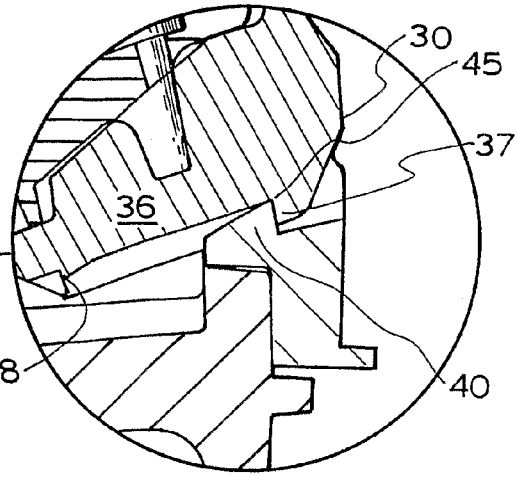
FIG. 6 is a detailed view of FIG. 5.
Figure 7:
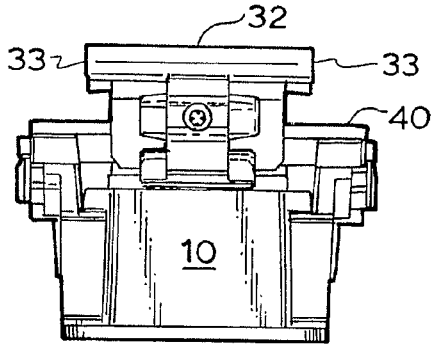
FIG. 7 is a plan view of the shoulder, the shoulder insulator and the toe insulator without a rail clip in the installed position.
Figure 8:
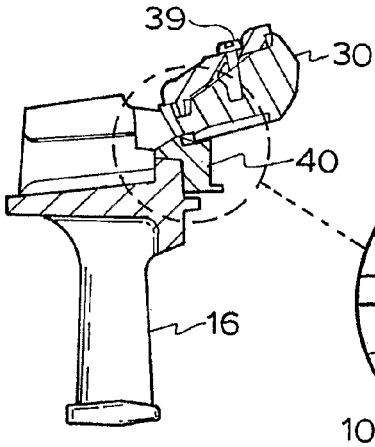
FIG. 8 is a sectional view of FIG. 7.

The toe insulator 30 also interacts with the shoulder insulator 40 to further stabilize the arrangement in the parked and installed positions. This can be seen in FIGS. 5 to 9. The bottom surface 36 of the toe insulator 30 includes two ratchet like protrusions 37 and 38 that interact with a complementary retention protrusion 45 on the top surface of the shoulder insulator 40. In the parked position protrusion 37 engages the retention rib 45 as seen in FIG. 6 to retard rear ward movement.

Figure 9:
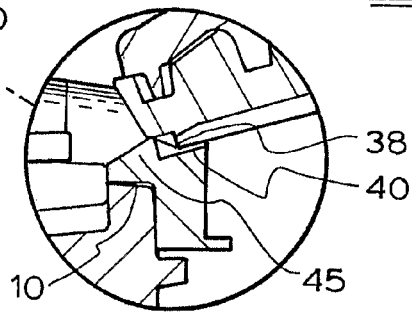
FIG. 9 is a detailed view of FIG. 8.
Figure 10:
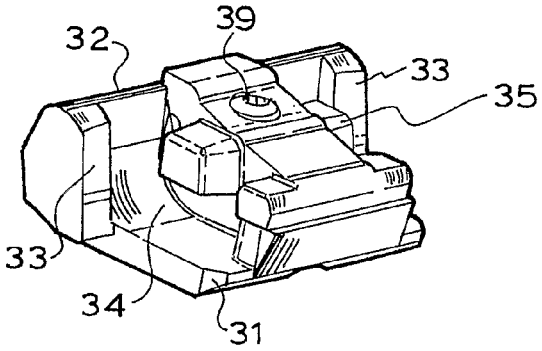
FIG. 10 is a view of the toe insulator.
Figure 11:
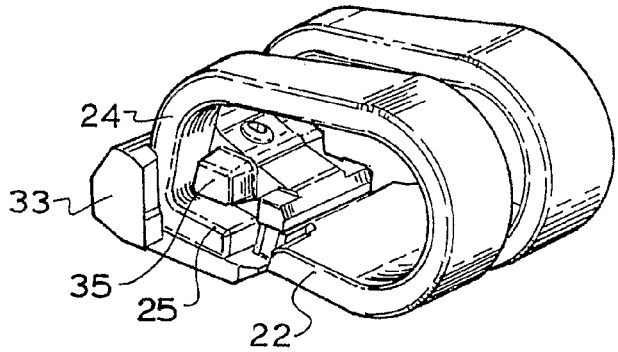
FIG. 11 illustrates the clip and toe insulator assembled.
Figure 12:
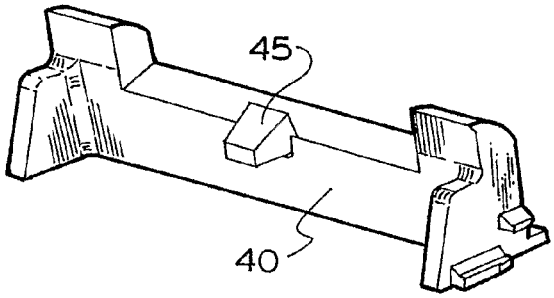
FIG. 12 is a rear perspective view of the shoulder insulator.
Figure 13:
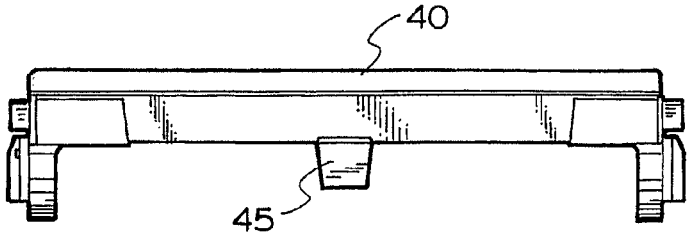
FIG. 13 is a plan view of FIG. 12.

In the installed position as shown in FIG. 9 the protrusion 38 engages retention rib 45 if the clip starts to move backwards.

Another design feature of the fastener relates to the phenomenon commonly referred to as "clip back-out". An opening is located inside the shoulder housing, at the end of the shoulder slot, prior to the front face of the shoulder. As the clip traverses the shoulder slot during installation, the maximum applied stress on the clip is reached just prior to the clip base traversing into the shoulder opening. When fully installed, the clip base enters the shoulder opening, lowering the stress on the clip enough to mechanically inhibit the back-off motion of the clip. To remove the clip, a large lateral force away from the rail must be applied to the clip by machine or dedicated hand tool.

When ties are en-route to the track installation site, it is possible for the pads on the top layer to be blown off. This is prevented in this invention by the clip 20 and toe insulator 30 in the parked position applying a small downward force on the shoulder insulator 40 and rail pad 3.

Those skilled in the art will realize that the present invention provides a rail tie assembly that is easy to fabricate and assemble. Although one particular embodiment has been described, those skilled in the art will realize that variations and modifications may be made without departing from the core teachings of the invention.

The invention claimed is:

1. A railroad tie and rail seat assembly for supporting a rail which includes:

a. a rail tie;

b. a pair of rail clip support shoulders attached to the said rail tie and each said shoulder having a rail base abutment face and on the opposite side there is a slot which extends towards the rail and is capable of accepting a clip base when applied laterally towards the rail;

c. a pair of shoulder insulators each shaped to lie between the rail base edge and the rail abutment face of the shoulders:

d. a pair of rail clips each having a base section adapted to slide into the rail clip support shoulder slot and a toe section adapted to seat on the rail base, the toe section comprising a pair of bifurcated arms extending from the said base section and being bent into a curve so that the toes lie adjacent but beyond the clip base;

e. a pair of toe insulators each captive on the rail clip toes to electrically insulate the clip from the rail base, each rail clip and captive toe insulator forming a clip and toe insulator assembly;

f. the clip and toe insulator assembly is configured to be placed in a loaded position on the rail clip support shoulder in a vertical direction so that parts of the toe insulator seat within pockets in the rail clip support shoulder that enable the clip and toe insulator assembly to move laterally towards the rail but not away from the rail in the loaded position, wherein the toe insulator includes a wing configured to abut with portions of the support shoulder to prevent movement of the toe insulator away from the rail in the loaded position;

g. in the loaded position the clip base is aligned with the shoulder slot and enters the shoulder slot when the clip and toe insulator assembly is moved, laterally to a parked position in which the clip and toe insulator lie outside limits of the rail base; and h. in an installed position for the clip and toe insulator assembly the toe insulators sit on top of the rail base and securely hold the rail base down.

2. A rail seat assembly comprising:

a rail clip including a base section, which is configured to slide into a slot of a rad clip support shoulder, and a toe section, which is configured to seat on a rail base of the rail clip support shoulder, placing the rail clip adjacent a rail;

a toe insulator captive on the rail clip and configured to electrically insulate the rail clip from a rail base, the rail clip and captive toe insulator forming a clip and toe insulator assembly, wherein:

the clip and toe insulator assembly is configured to be placed in a loaded position on the rail clip support shoulder in a vertical direction so that parts of the toe insulator seat within pockets in the rail clip support shoulder that enable the dip and toe insulator assembly to move laterally towards the rail but not away from the rail in the loaded position, wherein the toe insulator includes a wing configured to abut with portions of the rail clip support shoulder to prevent movement of the toe insulator away from the rail in the loaded position;

in the loaded position the clip base is aligned with the shoulder slot and enters the shoulder slot when the clip and toe insulator assembly is moved laterally to a parked position in which the clip and toe insulator lie outside limits of the rail base; and in an installed position for the clip and toe insulator assembly the toe insulators sit on top of the rail base and securely hold the rail base down.

* * * * *